United States Patent [19]

Dello

[11] 4,356,885

[45] Nov. 2, 1982

[54] CHAMBERED-CORE MOTORCYCLE-EXHAUST APPARATUS

[76] Inventor: Christy J. Dello, 1035 E. Third St., Corona, Calif. 91720

[21] Appl. No.: 294,441

[22] Filed: Aug. 20, 1981

[51] Int. Cl.[3] ..... F01N 7/08

[52] U.S. Cl. ..... 181/227; 181/240; 181/249

[58] Field of Search ..... 181/227, 228, 232, 240, 181/248, 249, 250, 251

[56] References Cited

U.S. PATENT DOCUMENTS 3,104,733 9/1963 Ludlow ..... 181/227

3,858,678 1/1975 Haren ..... 181/227

*Primary Examiner*—Benjamin R. Fuller

*Attorney, Agent, or Firm*—Francis X. LoJacono

[57] ABSTRACT

A chambered-core motorcycle-exhaust apparatus having an inner exhaust core system comprising a plurality of interconnected pipe segments, including a muffler-end segment, wherein the inner core is mounted within a tubular housing having a substantially larger diameter than the inner core, so as to establish an annular chamber between the outer housing and the inner exhaust core, to prevent substantial heat transfer to the outer housing and to reduce noise output normally associated with motorcycle exhaust systems.

4 Claims, 7 Drawing Figures

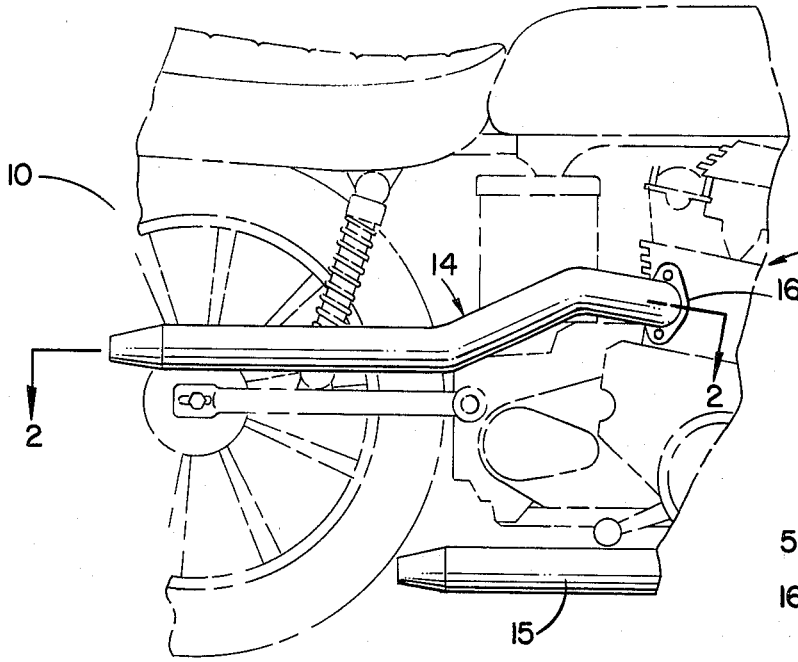
FIG. 1
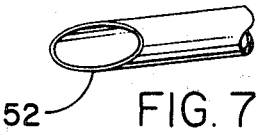
FIG. 7
FIG. 6
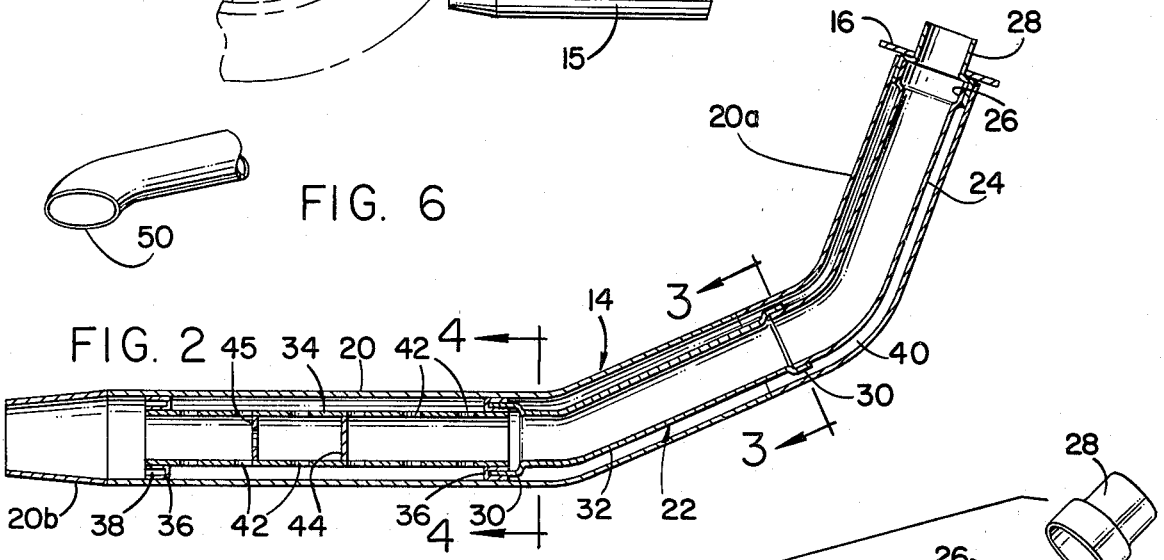
FIG. 2
FIG. 5
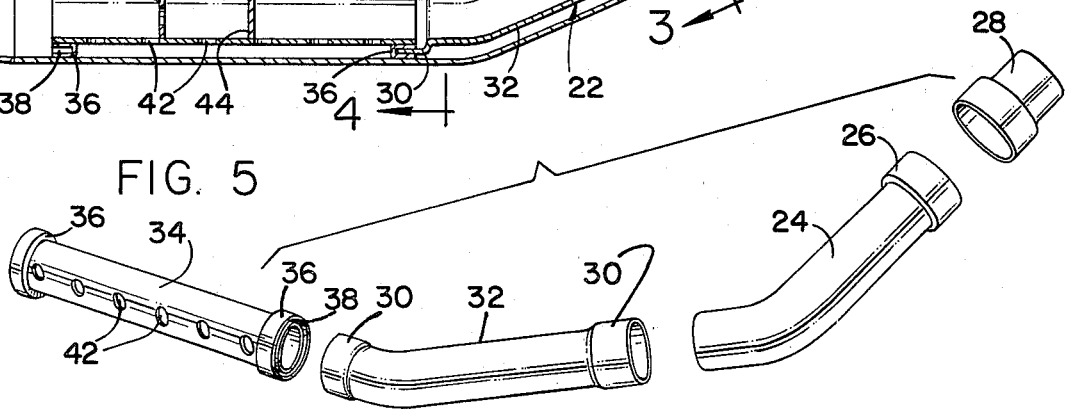
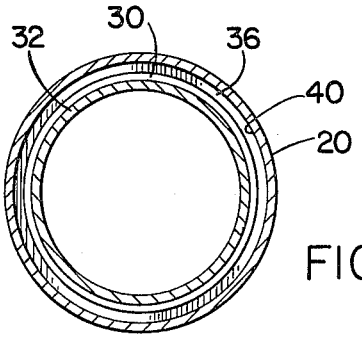
FIG. 4
FIG. 3
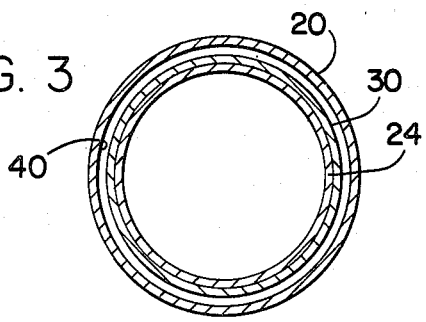

CHAMBERED-CORE MOTORCYCLE-EXHAUST APPARATUS

BACKGROUND OF THE INVENTION

1. Field of the Invention

This invention relates generally to a motorcycle exhaust system, and more particularly to a motorcycle-exhaust system having an inner exhaust core mounted within a housing having a larger diameter.

2. Description of the Prior Art

It is well known in the art that various problems and difficulties are being encountered in providing a suitable means for preventing and/or controlling simultaneously the excessive heat and noise conditions normally associated with motorcycle exhaust systems.

Various well-known types and designs of motorcycle exhaust systems are presently in use, but these have not been extensively modified to prevent excessive heating and noise. Most of the changes have been in design configurations only, and these designs generally conform to the particular motorcycle configuration. Basically, a housing is designed to custom fit the specific machine, so as to eliminate as much as possible any contact with or discomfort to the rider.

Further, since the owners of such vehicles are usually very meticulous as to the appearance and condition of their motorcycles, there is a great desire on their part to prevent "blueing" of the chrome exhaust fixtures, which is due to excessive heat transfer. Several means have been employed to prevent this reaction to heat, but they have not been very successful.

In addition, various muffler devices have been tried with only little success, due to restriction of the operational capabilities of the motorcycle engines.

Thus, there is a great need at the present time for an exhaust system that will overcome the above-mentioned problems.

SUMMARY OF THE INVENTION

The present invention has for an important object to provide a new and improved exhaust system for motorcycles that will prevent excessive transfer of heat, and provide a greatly reduced noise level. The exhaust system is formed having an inner exhaust core of a plurality of tubular elements, including an exhaust muffler unit that is adapted to receive the exhaust from the vehicle engine and to absorb the heat emanating therefrom. The inner exhaust is mounted within an outer housing having a substantially larger diameter, so as to create an air space or chamber between the inner core and the housing.

It is another object of the invention to provide a new and improved motorcycle exhaust system having an inner exhaust core that prevents chrome discoloration of the outer housing.

Still another object of the present invention is to provide an exhaust system of this character that lends itself to many design configurations, so as to be compatible with any motorcycle body style.

A further object of the invention is to provide a motorcycle exhaust system that includes an outer elongated housing, the diameter of which is sufficiently greater than average throughout its total length, providing an exhaust housing of at least two and one-half inches in diameter extending from its forward connecting end to its rearward discharge end.

It is still a further object of the present invention to provide an improved motorcycle exhaust apparatus that is relatively inexpensive to manufacture and is easily maintained.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a side-elevational view of the presently designed motorcycle-exhaust system shown mounted to a motorcycle in a typical manner;

FIG. 2 is a longitudinal cross-sectional view of the chambered core exhaust pipe taken substantially along line 2—2 of FIG. 1;

FIG. 3 is an enlarged cross-sectional view taken along line 3—3 of FIG. 2, illustrating a coupling connection between two tubular pipe sections;

FIG. 4 is an enlarged cross-sectional view taken along line 4—4 of FIG. 2, illustrating the mounting of the inner pipes;

FIG. 5 is an exploded perspective view of the inner exhaust assembly; and

FIGS. 6 and 7 are examples of various configurations of the free ends of the outer housing.

DESCRIPTION OF THE PREFERRED EMBODIMENT

Referring more particularly to FIG. 1, there is shown a portion of a motorcycle, generally indicated at 10, having an engine 12 to which one or more exhaust systems (indicated at 14 and 15) are mounted in the well-known manner by a flange mount 16.

It should be noted that the overall configuration as herein shown is by way of example. Various longitudinal configurations can be provided, depending upon the make and model of the motorcycle.

As seen in FIG. 2, there is shown in cross-section a new and improved construction of an exhaust system, herein referred to as a chambered-core motorcycle apparatus, comprising an inner exhaust core 22 and an outer housing 20 having a larger diameter than the inner core.

Outer housing 20 is provided with a plurality of bends to establish a particular longitudinal configuration. It is contemplated that the diameter of the housing should be between two and one-quarter to three and one-quarter inches, but the preferred diameter is two and one-half inches. The outer housing 20 is preferably formed from sixteen or eighteen gauge steel, and the outer surface can be chrome-plated if desired. Because of the various configurations, housing 20 might require several interconnected sections such as **20*a* shown at the mounting end and section 20*b*** shown at the exhaust-discharge end.

Co-axially supported within tubular housing 20 is an inner exhaust-core assembly, indicated generally at 22. This assembly is formed from a plurality of inner pipe sections that will also vary according to the given configuration.

Assembly 22 as herein shown comprises a first inner pipe section 24 which is provided at one end thereof with an enlarged flared diameter boss 26. This boss is adapted to receive a nipple member 28 thereon, the two members 26 being affixed to each other and the nipple extending outwardly from housing section 20*a*, so as to be received in the exhaust opening of engine 12 in the well known manner. Nipple member 28 is either welded or swaged in end section 20*a*, and flange 16 is secured over nipple 28.

The opposite end of pipe section 24 is adapted to fit into one of the enlarged outer annular boss members 30 of the second inner pipe section 32. Pipe section 32 includes oppositely disposed boss members 30, each of which has an inner diameter equal to the outer diameter of the pipe section 24 which fits therein, the outer diameter of section 24 being preferably one and three-quarter inches.

Fixedly positioned within the outer housing 20 adjacent its free open end is a muffler means comprising a central core 34 supported therein by a pair of annular ring members 36 formed to provide an annular channel 38. Each ring member has an outer diameter equal to the inner diameter of the outer housing 20, whereby the muffler is secured to the housing at both ends, the annular channel 38 being adapted to receive boss 30 of the adjacent section 32.

Accordingly, the inner exhaust assembly forms a centrally suspended core which defines a cooling and sound-deadening dead-air chamber 40 between the outer tubular housing 20 and the inner exhaust-core assembly 22. Thus, it can be readily understood that the hot exhaust gases are not allowed to directly impinge upon the inner surface of the housing 20, or any section thereof. As they enter nipple 28, the hot exhaust gases are dissipated through two layers or bands of metal provided by the enlarged portion of the nipple and the boss 26 of section 24. Further, the heat is dissipated along the inner adjoining pipe members. A deadening effect is also established by means of dead-air chamber 40. Thus, the exhaust gases are substantially cooled as they pass through muffler means 34.

It should be noted that various muffler cores can be employed, but the preferred form is herein shown as having two oppositely disposed rows of holes 42 which allow the exhaust gases to pass around and through baffles 44 and 45, respectively.

FIGS. 1 and 2 illustrate the discharge open end 20*b* as having a tapered conical configuration. However, other configurations are adaptable, such as an arcuate turn-out end 50 illustrated in FIG. 6, or an angular cut as at 52 in FIG. 7.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A chambered-core motorcycle-exhaust apparatus, comprising:

an outer, elongated, tubular housing, one end of which is adapted to be secured to a motorcycle engine, and the opposite end of which is formed as an open free end;

an inner exhaust assembly mounted longitudinally within said housing;

a dead-air chamber formed between said outer housing and said inner exhaust assembly, whereby heat transfer and engine noise are substantially reduced;

means to support said inner exhaust assembly within said outer housing, in order to define said dead-air chamber; and means attached to said exhaust apparatus for mounting said exhaust apparatus to said motorcycle engine;

wherein said inner exhaust assembly is co-axially mounted within said outer housing, and comprises:

a first inner pipe section having one end thereof formed with an enlarged annular boss member;

a nipple member adapted to receive said enlarged annular boss member therein, said nipple member being affixed to said outer housing and extending outwardly therefrom to engage said engine;

a second inner pipe section adapted to be connected to said first inner pipe section at one end thereof, the opposite end thereof having a boss member with an enlarged diameter; and a muffler secured adjacent said open free end of said housing, and including oppositely disposed ring members interposed between said pipe sections and said outer housing, whereby said dead-air chamber is defined therebetween and said enlarged boss of said second inner pipe section is adapted to be connected to one of said ring members.

2. An exhaust apparatus as recited in claim 1, wherein said support means is defined by said ring members of said muffler and said nipple member.

3. An exhaust apparatus as recited in claim 2, wherein said outer housing has an outer diameter of two and one-half inches, and said inner pipe sections have a smaller outer diameter of one and three-quarter inch, whereby said dead-air chamber is established to substantially reduce heat transfer and engine noise emanating from said inner exhaust assembly.

4. An exhaust apparatus as recited in claim 2, wherein said attaching means comprises a flange-mount member secured to said apparatus adjacent said nipple member.

* * * * *